US005478075A

United States Patent [19]

Saia et al.

[11] Patent Number: 5,478,075

[45] Date of Patent: Dec. 26, 1995

[54] GOLF CLUB STABILIZER

[76] Inventors: Carman R. Saia, 1656 Summit Ct.; Greg Foster, 3220 Maryland Pl., both of Bellingham, Wash. 98226-9410

[21] Appl. No.: 266,738

[22] Filed: Jun. 27, 1994

[51] Int. Cl.[6] ..... A63B 53/00

[52] U.S. Cl. ..... 273/81 R; 273/80 B

[58] Field of Search ..... 273/80 R, 80 A, 273/80 B, 80 C, 81 R, 81 D, 80.2, 80.83, 80.4, 80.5, 80.6, 80.8, 73 J

[56] References Cited

U.S. PATENT DOCUMENTS

| | | | |
|---|---|---|---|
| 1,580,744 | 4/1926 | Harmon | 273/81 R |
| 1,704,544 | 3/1929 | Jovak | 273/81 R |
| 1,950,342 | 3/1934 | Meshel | 273/80 |
| 2,023,131 | 12/1935 | Gibson | 273/80 |
| 2,085,915 | 7/1937 | MacCallum | 273/80 |
| 2,992,828 | 7/1961 | Stewart | 273/80 |
| 3,372,932 | 3/1968 | Molis | 273/81 R |
| 3,679,207 | 7/1972 | Florian | 273/80 |
| 3,762,707 | 10/1973 | Santorelli | 273/80 |
| 3,833,223 | 9/1974 | Shuikin | 273/194 |
| 3,897,058 | 7/1975 | Koch | 273/81 R |
| 4,058,312 | 11/1977 | Stuff et al. | 273/77 A |
| 4,203,598 | 5/1980 | Stuff et al. | 273/77 A |
| 4,452,456 | 6/1984 | Kochevar | 273/169 |
| 4,461,479 | 7/1984 | Mitchell | 273/81 A |
| 4,470,600 | 9/1984 | Parente et al. | 273/80 B |
| 4,496,153 | 1/1985 | Kochevar | 273/80.8 |
| 4,690,407 | 9/1987 | Reisner | 273/81 A |
| 4,988,102 | 1/1991 | Reisner | 273/81 A |
| 5,004,236 | 4/1991 | Kameshima | 273/80 B |
| 5,054,781 | 10/1991 | Soong | 273/80 B |
| 5,083,780 | 1/1992 | Walton et al. | 273/80 B |
| 5,253,867 | 10/1993 | Gafner | 273/80 R |
| 5,261,669 | 11/1993 | Kochevar | 273/169 |
| 5,294,119 | 3/1994 | Vincent et al. | 273/80 B |

FOREIGN PATENT DOCUMENTS

| | | | |
|---|---|---|---|
| 0134473 | 3/1985 | European Pat. Off. | 273/73 J |
| 20180 | 9/1904 | United Kingdom | 273/81 A |
| 2149311 | 6/1985 | United Kingdom | 273/73 J |

*Primary Examiner*—V. Millin
*Assistant Examiner*—S. Wong
*Attorney, Agent, or Firm*—Seed and Berry

[57] ABSTRACT

A golf club stabilizer having a plurality of radially expanded rubber discs all energized by a single threaded energizing rod. All of the discs can be expanded into contact with the shaft of the golf club uniformly or they can be varied in selectively different amounts. The discs can all be tightened to make the club very stiff or they can be tightened only loosely to make the club more stiff than without the discs but less than with fully tightened discs. The kick point of the club can also be varied by leaving some of the discs in a relaxed state out of contact with the shaft and doing this with any of the discs along the several discs in the club.

15 Claims, 4 Drawing Sheets

GOLF CLUB STABILIZER

TECHNICAL FIELD

This invention relates to improvements to stiffen a desired location in a golf club to control the flex and/or twist in the club.

BACKGROUND OF THE INVENTION

When playing golf, the golfer often strives to obtain the longest distance when striking the ball in order to carry the ball further down the fairway. This can be accomplished either by developing the strength and skill of the golfer or using a golf club shaft of a more flexible material such as light, thin-walled tubular metal, fiberglass, carbon fiber, or other composites. The added flexibility in the shaft is intended to deliver the head of the shaft at a greater velocity when the head strikes the ball. This greater velocity being achieved not only by the stroke of the golfer swinging the club, but also the recovery of the energy stored in the shaft when it is initially being flexed so that part of that springiness in the flex will be recovered as velocity at the club head just prior to striking the ball.

The difficulty with more flexible golf club shafts, however, is that the less experienced golfer loses control of the exact angle at which the face of the club head strikes the ball at the moment of contact with the ball. This results in the ball not traveling straight even though it may have a longer distance. In addition, the increased flex of the shaft will result in a twist at the grip end of the shaft or a bending at the grip end of the shaft which results in the golfer loosening the golfing grip, allowing the club to slip or twist in the hands of the golfer. This destroys the desired feel of the club grip, and also can cause the ball to travel in a non-straight path.

Different types of shaft stiffening devices have been shown in prior literature. However, these are difficult to install and, once installed, result in a permanent change in the stiffness of the club shaft.

SUMMARY OF THE INVENTION

The present invention provides a solution to the golf club flexing of modern golf club shafts by providing an adjustable stiffening means, preferably in the grip end of the shaft, allowing the stiffness of the grip end of the shaft to be varied from very stiff to lightly stiff.

In one embodiment of the invention, the stiffening means includes stiffening members spaced in the grip end of the shaft and any one of the gripping members can be expanded into contact with the shaft relative to the others to vary the stiffness along the length of the grip end of the shaft.

The advantages of the adjustable stiffening members spaced along the grip end of the shaft are that the entire grip end of the shaft can be made stiffer, thus moving the kick-point of the shaft down further towards the head end of the shaft. This basically stiffens the club shaft so that some of the flex is removed, thereby giving greater control of the shaft and resulting in a straighter drive of the ball.

Another advantage is that the spaced stiffening members can be made to only lightly stiffen the grip end of the club, thereby allowing more flex, but some stiffness. Any combination of very stiff to lightly stiff along the entire length of the grip end of the club can be achieved. This stiffness can be varied as the golfer progresses in skill so that a golfer who initially finds a club too flexible can stiffen the club and as the golfer's skill increases, the amount of stiffness can be reduced accordingly.

The stiffening members can also be varied independently of one another along the length of the grip end of the shaft as, for example, to stiffen only the stiffening members adjacent the outer end of the shaft, thereby moving the kick point up further along the shaft but less than where its location would be without any stiffeners in the grip end of the shaft.

In addition, the spaced stiffening members along the length of the shaft can be varied independently of the others as for example by engaging the stiffening members at the grip end of the club closest to the head end and closest to the outer end but leaving a relaxed area with the stiffening members not engaged with the shaft in the center of the grip end of the club, to create a soft feel in the grip end of the club.

Accordingly, the invention should allow golfers to grow or adjust to their clubs as they acquire more skill, permanently control the amount of flex in the shaft or provide other variations of shaft stiffness and feel to accommodate their particular skill level and strength.

DETAILED DESCRIPTION OF THE INVENTION

Figure 1:
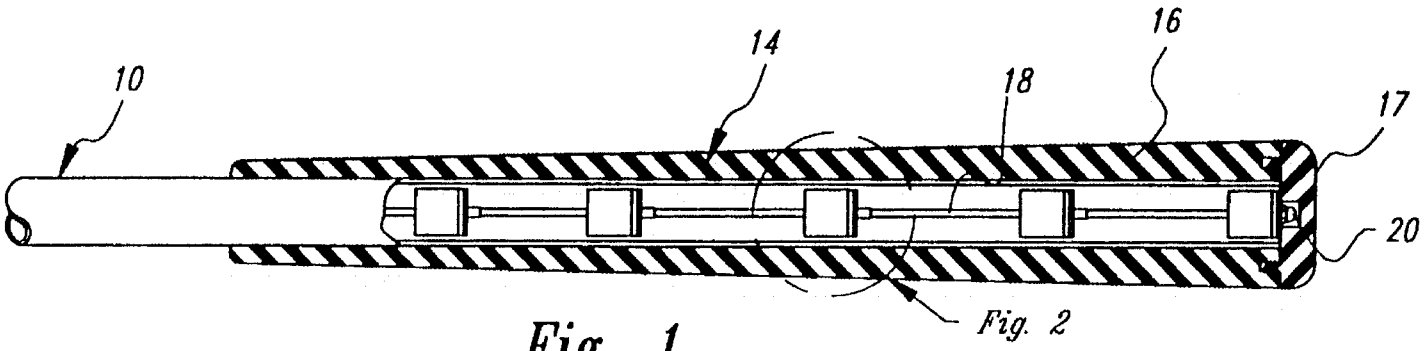
FIG. 1 is a fragmentary section of a hollow golf club shaft having adjustable stiffening mechanisms according to the teachings of the invention.
Figure 3:
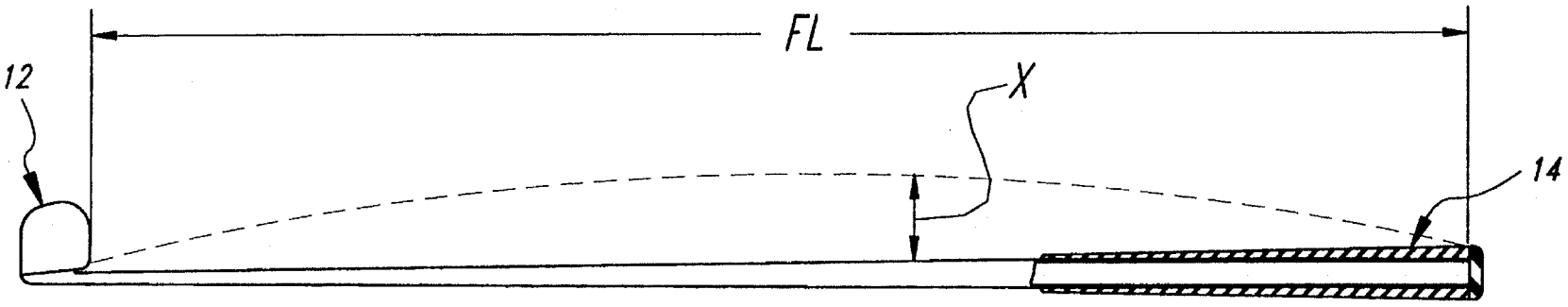
FIG. 3 shows a golf club shaft of standard configuration without the stiffening members of the instant invention.

FIG. 1 illustrates a typical golf club shaft 10 made from either lightweight tubular metal, fiberglass, carbon fiber or other composite materials. The hollow shaft has a head end 12 (FIG. 3) and a grip end 14. The grip end may be covered by a typical rubber wrap 16 sealed off by a plug 17.

Figure 2:
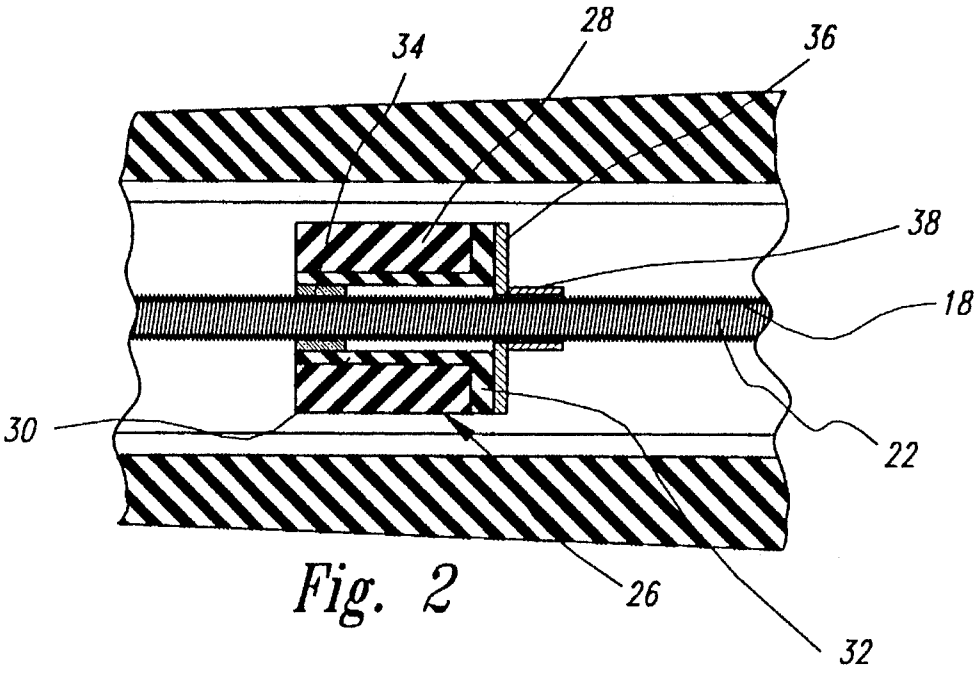
FIG. 2 is an enlarged detail of a portion of the shaft stiffening mechanism shown in FIG. 1.

As best shown in FIG. 1 and 2, stiffening or friction members 26 of this invention are activated by an elongated threaded rod 18 having at its outer end a lock nut 20 fixed to the rod and along its length a plurality of threads 22.

Each stiffening member 26 includes a soft rubber cylinder 28 fitted over a rubber sleeve 30. The rubber sleeve has an enlarged end 32 at one end and a threaded nut 34 which is bonded or vulcanized to the rubber sleeve at the opposite end of the sleeve. These sleeves are conventional devices and operate such that when the rod 18 is threaded through the nut 34, the nut moves axially to the right (in FIG. 2) along the threaded rod, squeezing the center portion of the rubber sleeve radially outwardly. This expands the rubber cylinder 28 outwardly into tight contact with the inner wall of the shaft. The amount of grip or tightness between the rubber cylinder and the shaft can be varied by the amount of torque placed on the rod 18.

In order for the sleeve to expand the enlarge end of the sleeve must be held against axial movement. This is achieved by the use of a washer 36 which abuts against a ferrule 38. The ferrule is locked to the threaded rod either by bonding, crimping, or by smashing a thread along the rod so that the ferrule cannot pass beyond the mashed thread.

Figure 4:
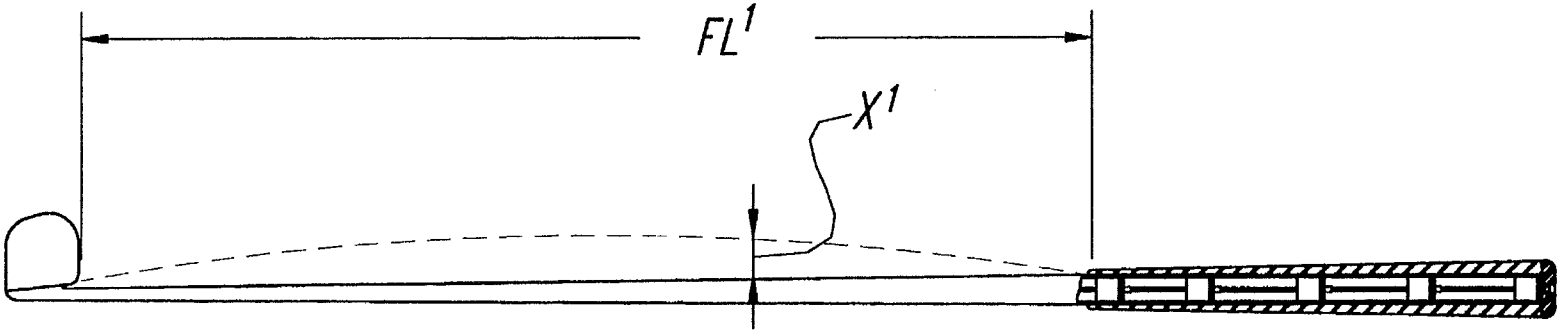
FIG. 4 shows a golf club shaft with the stiffening members of the invention showing an increased stiffness.

As best shown in FIG. 1, there are several of these gripping members 26, in one embodiment five spaced along the grip end. While these gripping members in the rod can be placed anywhere along the length of the shaft, they are preferably placed at the grip end of the shaft as shown. The gripping members 26 can all be simultaneously and uniformly radially expanded to the approximate same tightness against the inside of the shaft. This is accomplished by initially radially expanding each of the discs until they are in frictional engagement with the inside of the shaft when they are inserted into the grip end of the shaft. Then by rotating the lock nut 20 and the rod, all of the gripping members are simultaneously uniformly expanded into contact with the grip end of the shaft. This stiffens the entire grip end of the shaft and produces a reduced amount of flex, as shown in FIG. 4. In FIG. 4, the amount of flex is shown schematically as $X^1$, and the length of that flex along the handle is shown schematically as $FL^1$. This is to be compared with the schematic illustration of the greater amount of flex shown as X in FIG. 3 and with the greater length of the flex along the handle as shown as FL in FIG. 3.

Figure 5:
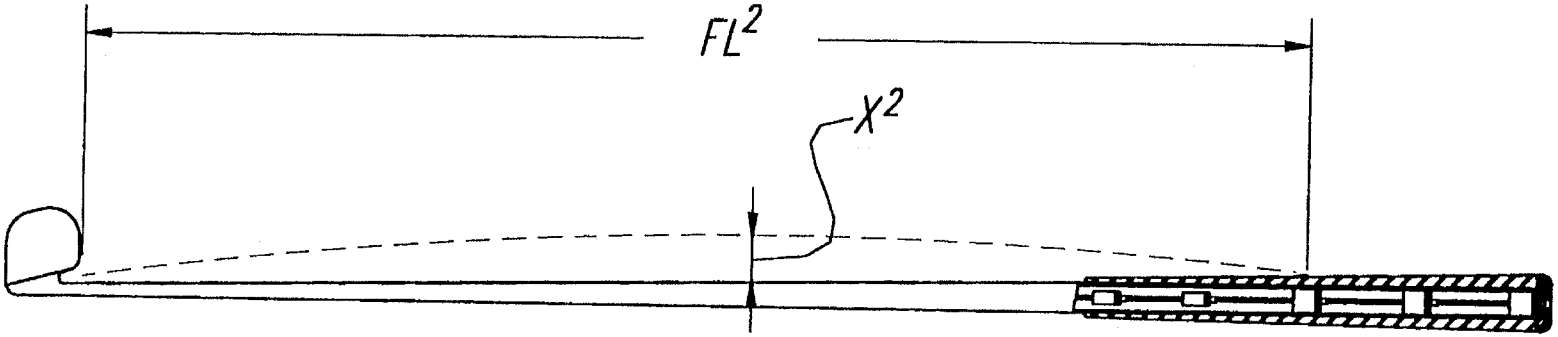
FIG. 5 is a golf club shaft with the stiffening members of this invention showing some of the stiffening members being energized and others not, and the resulting schematic illustration of the change in the flex of the shaft.

The gripping members can also be selectively radially expanded, either in groups or any particular one. FIG. 5 illustrates expanding the three most outward gripping members but leaving the two most inner gripping members in the relaxed or non-expanded state. This provides an amount of flex $X^2$ which is greater than $X^1$ but less than X, and a length of that flex $FL^2$ which is greater than the length of the flex $FL^1$ but less than the length of the flex FL. As is apparent, any one of these stiffening members can be left relaxed and any number can be expanded.

Figure 6:
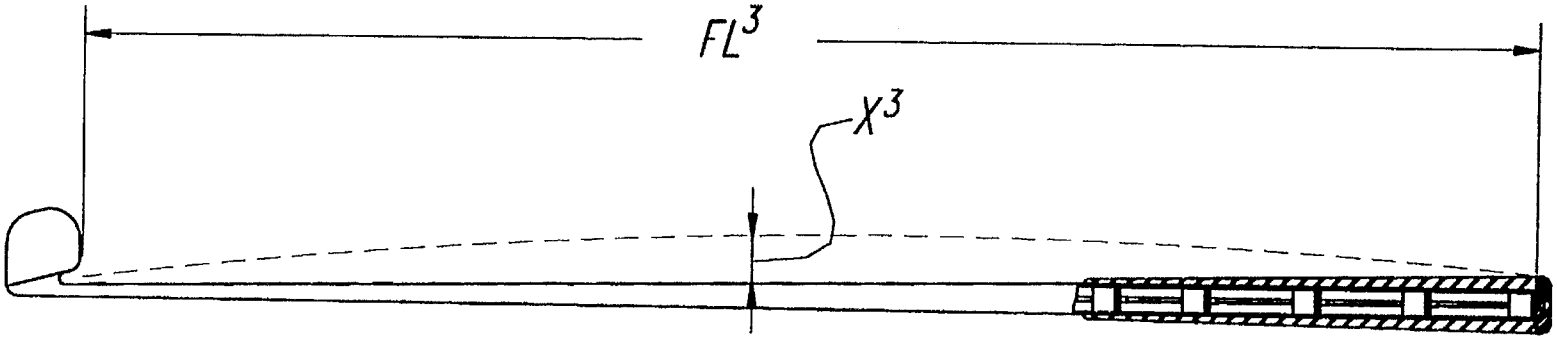
FIG. 6 shows a golf club shaft embodying the stiffening members of the invention with all the stiffening members only lightly pressed against the shaft, and showing schematically the resulting flex of the shaft.

FIG. 6 shows a situation in which all of the stiffening members 26 are radially expanded but to an amount less than the tightest amount that is illustrated by comparison in FIG. 4. While the stiffening members are all uniformly expanded, they are only uniformly expanded into lighter contact with the hollow shaft, resulting in an amount of flex $X^3$ which is somewhere less than flex amount X but greater than the flex amount $X^1$. Similarly, the length of that flex $FL^3$ is somewhat greater than that of $FL^1$ but is less than and is approximately the same as the flex length FL.

It should be understood that these exact amounts of flex and the lengths of flex are not exactly known, but are only interpreted in general terms as the resulting effect of tightening any or all of the stiffening members against the hollow shaft.

Figure 7:
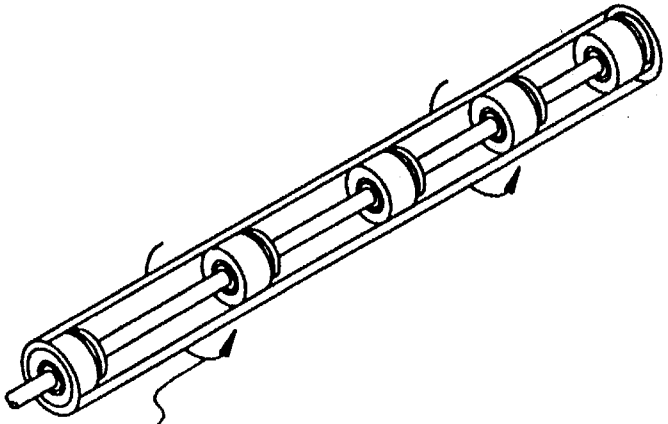
FIG. 7 shows the grip end of the shaft embodying the principles of the invention with all gripping members engaged producing a reduced amount of twist in the grip end of the shaft.

FIG. 7 illustrates a typical grip end of a shaft with the stiffening members all tightly expanded against the wall of the shaft. The arrows 40 are intended to show small amounts of twist in the handle, since the handle is more stiff and now resists the twist when the club strikes the ball.

Figure 8:
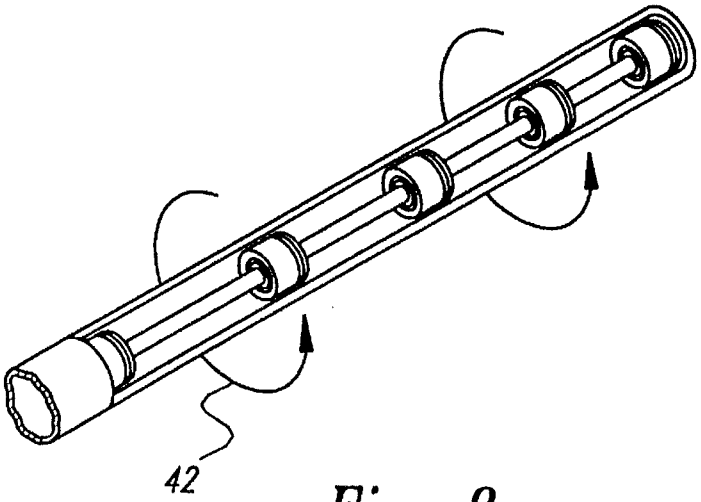
FIG. 8 shows the grip end of the shaft embodying the gripping members of the invention but with the gripping members all relaxed so that the club has its normal greater twist in the grip end of the handle.

By comparison, FIG. 8 shows a typical golf club grip end but with the gripping members 26 all in the relaxed state so that they have no effect on the grip end of the shaft. This results in larger twist shown by the longer arrows 42. Thus it can be shown that, not only do the stiffening members change the amount of flex in the club and the length of the flex in the club, but they also change the amount of twist in the club, reducing that twist where it is desirable for the particular golfer.

Figure 9:
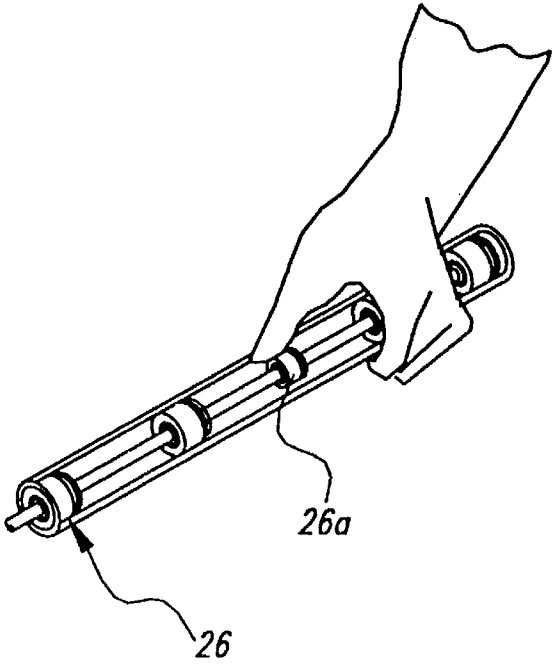
FIG. 9 shows a fragmentary grip end of a golf club shaft embodying the gripping members of the invention but with an intermediate gripping member relaxed, whereas the other gripping members are all expanded into contact with the shaft to show how the feel of the grip can be varied.

FIG. 9 illustrates a golf club grip end of the shaft with all of the gripping members 26 tightly engaged against the shaft except the intermediate or central-most gripping member. This gripping member is illustrated with reference number **26*a*** and is left in a relaxed state. This produces a slight softness or flex in the handle adjacent where the golfer will place his thumb, but retains greater stiffness outward and inward of that location. The resulting effect is a stiffer acting club but with a softer feel than would occur if all of the stiffening members were expanded against a shaft.

While the various embodiments of the invention have been illustrated and described, it should be understood that variations will occur to those skilled in the art without departing from the principles herein. For example, any one of the stiffening members 26 may be left relaxed while others are stiffened. Various lengths of energizing rods and stiffening members may be used for different clubs, for example, approximately 13 inches for a men's driver, 12 inches for other men's woods, and 11 inches for higher numbered woods such as a 5 wood and in some cases irons.

Women's clubs would generally have stiffening members and energizing rods about one inch shorter than the equivalent men's, being approximately 11 inches long for the highest wood such as a 5 wood or some of the irons, and 12 inches for the 3 wood and 13 inches for the driver.

As an alternative, a single set of discs and energizing rods can be used for all clubs, both men's and women's, and the stiffening effect adjusted by leaving the innermost disc or discs in the relaxed state so that the effect is similar to having used a shorter energizing rod and number of discs.

We claim:

1. A shaft stabilizer for hollow shaft golf clubs of the type having a shaft with a grip end at one end of the shaft and a head end at the opposite end of the shaft, comprising:

a plurality of radially expandable discs spaced from one another along the shaft; and a common activating rod operatively connected to each disc for selectively expanding the discs radially outwardly into tight engagement with the hollow shaft to stiffen the shaft at such points of engagement.

2. The stabilizer of claim 1 wherein the discs along the rod combine to have a cumulative length, and wherein all discs can be expanded uniformly to increase the stiffness of the shaft along the cumulative length of all discs.

3. The stabilizer of claim 1 wherein any disc can be expanded relative to another disc so that the stiffness can be made nonuniform along the length of the combined discs.

4. The stabilizer of claim 2 wherein any disc can also be expanded relative to another disc so that the stiffness can be made nonuniform along the length of the combined discs.

5. The stabilizer of claim 3, said discs each including a rubber sleeve having a threaded nut fixed inside the sleeve to the sleeve, said activating rod including a threaded rod, threaded through said threaded nuts, means for fixing each disc against movement along-the rod, and wherein rotation of the rod while the discs contact the shaft causes each nut to thread axially along the rod radially expanding the rubber sleeve to push the disc more tightly against the shaft.

6. The stabilizer of claim 5, said disc including a soft rubber cylinder fitted over said sleeve, said soft rubber cylinder engaging the shaft as the sleeve is expanded.

7. The stabilizer of claim 6, said disc further including a loose washer, said means for fixing the disc against movement along said rod including a ferrule locked to the rod, said washer abutting said ferrule, said sleeve having an enlarged end abutting the opposite side of said washer, said soft rubber cylinder fitted over the sleeve and abutting the enlarged end of the sleeve.

8. A shaft stabilizer for changing the stiffness of the grip end of the hollow shaft of a golf club having a grip end and a head end, comprising:

a plurality of spaced friction members within said grip end of the shaft, the friction members being spaced from one another along the shaft and a rigid energizing rod operative to simultaneously and uniformly radially expand all of the spaced friction members into tight engagement with said shaft to stiffen the grip end of the shaft uniformly along the length of said combined friction members and rod, thereby reducing the flex of the entire shaft and reducing twist in the grip end of the shaft.

9. The stabilizer of claim 8, said friction members including a plurality of radially expandable rubber discs threadably joined to said energizing rod.

10. A shaft stabilizer for varying the stiffness of the grip end of a hollow golf club shaft having a head end and a grip end, comprising:

a plurality of friction members spaced from one another along the inside of said hollow shaft at the grip end, and an energizing rod joined to said friction members and operable to selectively radially expand any combination of said friction members for varying the stiffness along the length of the grip end to give the club an adjustable stiffness in the grip end of the shaft.

11. The shaft stabilizer of claim 10, said friction members including a plurality of radially expandable rubber discs threadably engaged to said energizing rod.

12. The shaft stabilizer of claim 11 wherein only the discs nearest the outer end of the shaft of the grip end of the shaft are radially expanded and discs toward the head end are not expanded thereby limiting the stiffness only to the outer end of the shaft.

13. The shaft stabilizer of claim 11 wherein only the discs nearest the head end of the shaft and the outer end of the shaft are radially expanded leaving an intermediate disc unexpanded to give a softness to the grip end of the shaft.

14. A shaft stabilizer for changing the stiffness of a hollow shaft comprising:

an elongated spacer energizing rod, a plurality of friction members spaced from one another along said rod, said friction members including means adapted for radially expanding selected said friction members when placed in contact with a hollow shaft into tight engagement with said shaft to stiffen the shaft along the length of said selected friction members and rod, said friction members including a plurality of radially expandable discs, said discs each including a robber sleeve having a cylindrical body and having a nut secured thereto, and an elastic cylinder fitted over said sleeve cylindrical body, said energizing rod including, means for fixing each disc against movement along the rod, and wherein rotation of the rod moves the nut along the rod to radially expand the cylindrical body of the sleeve and thence the elastic cylinder fitted thereon.

15. The stabilizer of claim 14, said disc further including a loose washer, said means for fixing the disc against movement along said rod including a ferrule locked to the rod, said washer abutting said ferrule, said sleeve having an enlarged end abutting the opposite side of said washer, said elastic cylinder fitted over the sleeve and abutting the enlarged end of the sleeve.

* * * * *

UNITED STATES PATENT AND TRADEMARK OFFICE

CERTIFICATE OF CORRECTION

PATENT NO. : 5,478,075
DATED : December 26, 1995
INVENTOR(S) : Carman R. Saia; Greg Foster It is certified that error appears in the above-indentified patent and that said Letters Patent is hereby corrected as shown below:

In column 6, claim 14, line 25, delete "robber" and insert therefor --rubber--.

In column 6, claim 14, line 28, following "including" delete --,--.

Signed and Sealed this

Fourteenth Day of May, 1996

*Attest:*

*Attesting Officer*

BRUCE LEHMAN

*Commissioner of Patents and Trademarks*